US007216999B2

(12) United States Patent
Kaplan et al.

(10) Patent No.: US 7,216,999 B2
(45) Date of Patent: May 15, 2007

(54) CHEMILUMINESCENT ILLUMINATION DEVICE WITH ATTACHED TACTILE SLEEVE

(76) Inventors: Fred Kaplan, 96 Windsor St., West Springfield, MA (US) 01089; Earl Cranor, 24 Lincoln Park, Longmeadow, MA (US) 01106

( * ) Notice: Subject to any disclaimer, the term of this patent is extended or adjusted under 35 U.S.C. 154(b) by 24 days.

(21) Appl. No.: 11/135,692

(22) Filed: May 23, 2005

(65) Prior Publication Data

US 2006/0098420 A1 May 11, 2006

Related U.S. Application Data

(63) Continuation-in-part of application No. 10/984,549, filed on Nov. 8, 2004, now abandoned.

(51) Int. Cl.
*F21K 2/00* (2006.01)

(52) U.S. Cl. ..... 362/34; 362/84; 362/331

(58) Field of Classification Search ..... 362/34, 362/84, 331, 334, 101, 230, 231
See application file for complete search history.

(56) References Cited

U.S. PATENT DOCUMENTS

| | | | | |
|---|---|---|---|---|
| 3,576,987 A | | 5/1971 | Voight | |
| 3,584,211 A | | 6/1971 | Rauhut | |
| 3,813,534 A | * | 5/1974 | Gilliam | 362/34 |
| 4,061,910 A | * | 12/1977 | Rosenfeld | 362/34 |
| 4,245,282 A | | 1/1981 | Sokol | |
| 4,379,320 A | | 4/1983 | Mohan et al. | |
| 5,190,366 A | | 3/1993 | World | |
| 5,325,273 A | | 6/1994 | Kuo | |
| 5,383,100 A | | 1/1995 | Kikos | |
| 5,390,086 A | | 2/1995 | Holland | |
| 6,106,129 A | | 8/2000 | Cranor et al. | |
| 6,619,808 B1 | | 9/2003 | Pelto | |
| 6,776,495 B2 | | 8/2004 | Nomiyama | |
| 6,860,614 B1 | | 3/2005 | Pinciaro | |
| 2003/0137826 A1 | * | 7/2003 | Nomiyama | 362/34 |
| 2004/0141310 A1 | | 7/2004 | Fujita | |

* cited by examiner

*Primary Examiner*—Renee Luebke
*Assistant Examiner*—Gunyoung T. Lee
(74) *Attorney, Agent, or Firm*—McHale & Slavin

(57) ABSTRACT

A chemiluminescent lighting device having a flexible casing surrounding the source of light. A separate transparent, translucent or opaque sleeve is placed about the casing to improve the gripping and the aesthetic feel of the device while passing the light. The sleeve may be in the form of a spiral or net exposing portions of the casing. The sleeve may include colored polymers to produce multi-colored effects. The sleeve may also include fluorescers to retain intensity and/or change colors. The lighting device enhances the visual appeal of novelty items such as necklaces and bracelets, and provides a tactile grip when used as a hand-held illumination device.

8 Claims, 4 Drawing Sheets

CHEMILUMINESCENT ILLUMINATION DEVICE WITH ATTACHED TACTILE SLEEVE

RELATED APPLICATIONS

This application is a continuation in part of U.S. application, Ser. No. 10/984,549, filed Nov. 08, 2004 now abandoned.

FIELD OF THE INVENTION

This invention relates to the field of chemiluminescent illumination devices and in particular to the use of an enlarged sleeve that can be coupled to a chemiluminescent source of light.

BACKGROUND OF THE INVENTION

Chemiluminescent illumination devices are non-incandescent products which produce light from a chemical mixture. The basic chemiluminescent process produces light when two chemical solutions are combined. The solutions may be combined and frozen to prevent activation or can be kept physically separated prior to activation. Physical separation typically consists of a sealed frangible glass vial containing a first solution that is placed within a second solution, both of which are housed in a sealed flexible vessel. When the vessel is flexed, the glass vial is ruptured thereby releasing the vial solution which admixes wherein the reaction produces light.

The chemical solutions are generally referred to as the "oxalate" component and the "activator" component. A typical oxalate component consists of Dibutyl Phthalate, CPPO and CBPEA. A typical activator solution contains Dimethyl Phthalate, T-butyl alcohol, 90% aq. Hydrogen Peroxide and Sodium Salicylate. As previously mentioned, the components may be frozen to retard the progress of the reaction. Alternatively, the components may be separated by a vial, pellet, separating wall, and so forth. Despite the type of separation, the object of these devices is to produce usable light. For this reason, the outer vessel is made of a light-filtering plastic material which permits the light produced by the reaction to pass through the vessel walls.

Numerous patents exist that disclose improvements in the oxalate and activators, such patents extending the illumination properties of chemiluminescent devices. The unique lighting effects generated from chemiluminescent lighting devices are enhanced by the inherent optical properties of the containing vessel. The color, clarity and degree of effervescence, if any, serve to add to dissipation of light throughout the vessel wall. Some dyes or coloring agents can be used not only as color filters but as fluorescers. A fluorescent dye functions by converting light of one wavelength to another wavelength. For example, blue light from a chemiluminescent device might be converted to red light by employing an appropriate fluorescer. This red light could be produced even if there was little or no red light emitted by the chemiluminescent device. When used with novelty items, most of these improvements strive to create attractive illumination about the area around the vessel and within the vessel itself.

The use of a dye and/or fluoresecer in the vessel casing is also well known, being first disclosed in U.S. Pat. No. 3,584,211 which sets forth a vessel casing for use with chemiluminescent light wherein the visible color of the light emission can be varied by using colored plastic.

U.S. Pat. No. 3,576,987 disclosed a multi-colored plastic casing for housing chemiluminescent reactants. The color of light emission depended upon the type of fluorescent compound used in the plastic casing and its spectral response. However, the visible color could also be varied by simply using a colored plastic.

U.S. Pat. No. 4,379,320 discloses a chemical light device having a chemiluminescent solution with a first fluorescer contained in a transparent or tranlucent vessel with a second fluorescer incorporated in the walls of the vessel to shift at least a part of the shorter wavelength emission of the first fluorescer to a longer wavelength emission of the second fluorescer.

U.S. Pat. No. 5,190,366 discloses a multi-colored chemiluminescent fishing lure formed from a connector body having a plurality of color tubes in a predetermined angular relationship.

U.S. Pat. No. 6,860,614 to Pinciaro discloses a chemiluminescent jewelry item with a sleeve, in the form of a helix, for attaching the chemiluminescent tube to the support plate.

Assignee Omniglow has sold wrapped chemiluminescent tubes consisting of a transparent plastic chemiluminescent lighting device with a plastic wrap secured thereto, the plastic wrap having various designs printed thereon including multi-color designs of cakes, presents, confetti, and "Happy Birthday". Omniglow has also sold chemiluminescent lighting devices formed from a clear plastic vessel casing with colored plastic end caps. In addition, chemiluminescent lighting devices have been sold wherein half of the chemiluminescent lighting device is painted red with a sliding "over tube" to block out the painted portion and/or the non-painted portion.

While the chemiluminescent lighting devices have many advantages, the separation of the chemical components before use and the need to utilize a type of material that is chemically resistant to the components, limit the type of vessel materials to polyethylene, polypropylene and the like plastic, all of which do not inherently have tactile properties. Further, these materials are usually extruded in a tubular shape producing a monotonous surface area.

What is needed in the art is a separate sleeve surrounding the light source which improves the tactile property of the lighting device and is capable of incorporating fluorescing material and/or materials emitting different colors and can be interchanged with other sleeves.

SUMMARY OF THE PRESENT INVENTION

Disclosed is a hand held illumination device having a flexible plastic vessel casing surrounding a chemical light source. A separate transparent, translucent, opaque or metallized sleeve of the instant invention is placed about the casing to improve the manual gripping and the aesthetic feel of the device or providing a novel way of changing colors or enhancing light emission along the length of the device, during transmission of the chemical light. The sleeve may be in the form of a spiral or net exposing portions of the casing. The sleeve may include colored polymers to produce multi-colored effects. The sleeve may also include fluorescers to retain light intensity and/or change colors. The sleeve may be a brightly colored metal or flexible plastic with a metal coating, simulating gold and silver.

Therefore, it is an objective of this invention to provide a chemiluminescent device with a separate sleeve for decorative and improved handling properties.

It is another objective of this invention to provide an enhanced lighting device for safety, signs, advertising devices, illumination devices and novelty applications, such as necklaces and light sticks.

Still another objective of this invention to provide an enhanced lighting device having additional "play value" allowing an individual to stretch, coil, slide, push & pull the wrap which also provide color changes when light passes through the wrap.

It is another objective of this invention to provide a hand held lighting device having improved tactile properties.

It is another objective of this invention to provide a lighting device that produces multicolored light in the visible and invisible spectrum.

It is a further objective of this invention to provide a lighting device that includes materials that will glow when struck with light.

It is yet another objective of this invention to provide a lighting device that produces multicolored visible light and will glow.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

As shown in the FIGS., the lighting devices 10 of this invention have a casing 11 through which light passes from the chemical reaction within the casing. The casing 11 may be made out of any material compatible with the chemiluminescent system inside. It can be clear, opaque, or colored, in whole or in part, or in combination. The colorant can be a dye, pigment, or fluorescer, or a combination. Additionally, the wall of the casing 11 can have materials embedded in it, such as, without limitation, glass, glitter, beads, etc. Glitter is defined to mean particles made from aluminum foil, plastic film, metallicized film, cellulose, paper, microspheres and/or nanodots.

Figure 1:
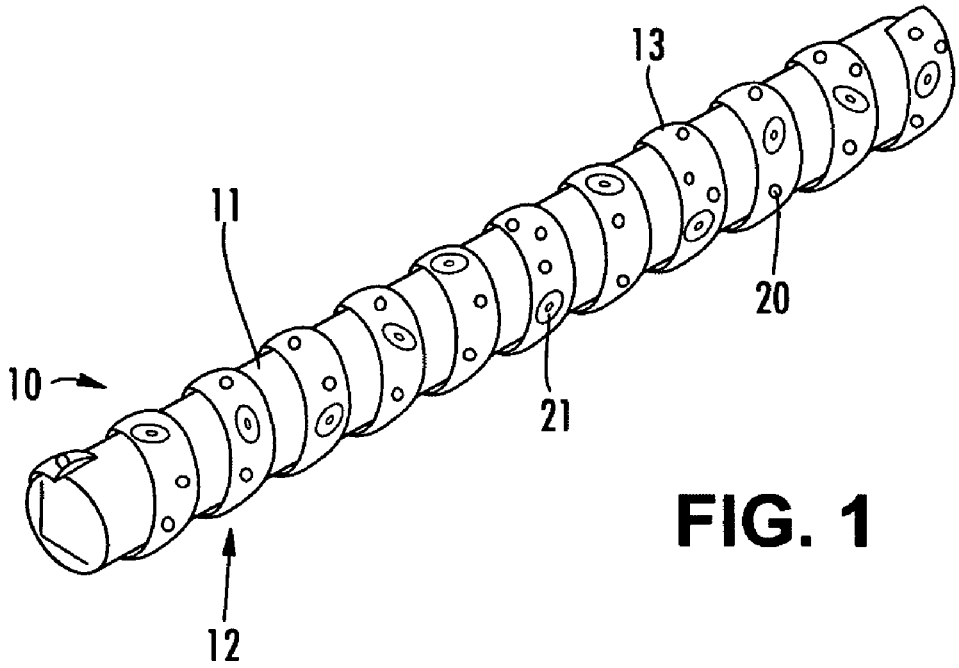
FIG. 1 is a perspective of a lighting device of this invention with a spiral sleeve.
Figure 2:
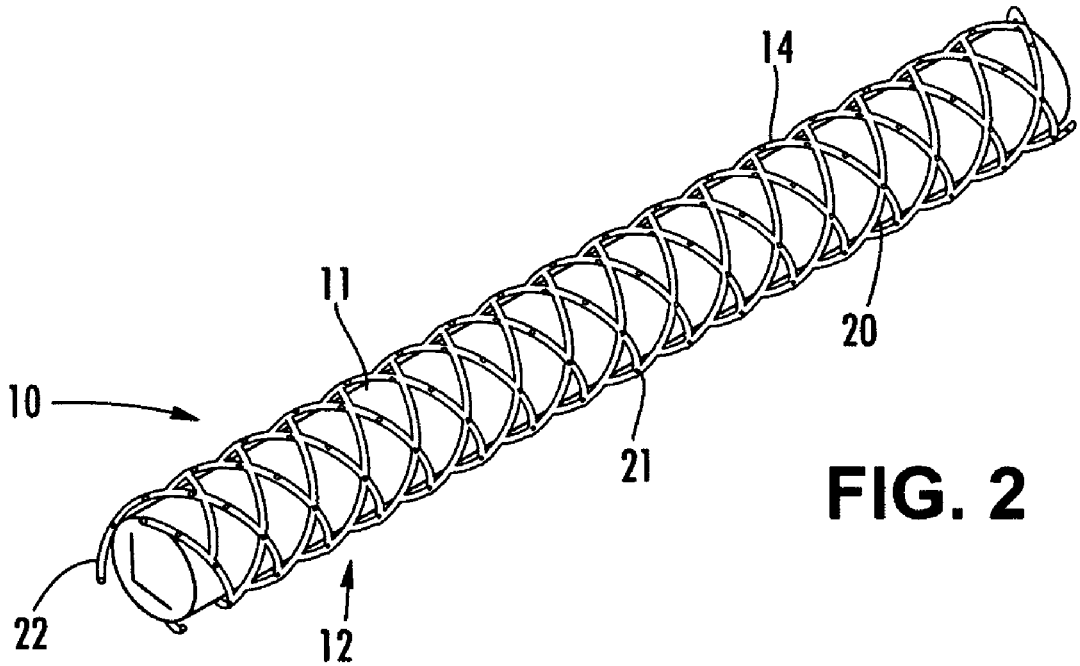
FIG. 2 is a perspective of a lighting device of this invention with a net sleeve extension.

Surrounding the casing 11 is a sleeve 12 which also passes light and may be transparent, translucent or opaque in whole or in part, or in combination. The sleeve 12 may include extensions 22 beyond the ends of the casing 11, as shown in FIG. 2. The sleeve is formed of a helix 13 which is separated so that alternating spirals of the helix and the casing are visible, as shown in FIG. 1. The sleeve 12 is formed as a net 14 with portions of the sleeve defining interstices which expose the casing, also shown in FIG. 2. The extensions 22 may be used as handles, swing handles, or for connection through the connector 30, as shown in FIGS. 3 and 4, to form a necklace or bracelet.

The sleeve 12 can be made from a different material than the polyethylene or polypropylene of the tubular casing 11. The sleeve is a polymer, such as vinyl, which is aesthetically pleasing when gripped or carried by the user. Because of the lands and grooves of the sleeve structure, the sleeve 12 adds a non-slip surface as well as a better tactile sensation. The sleeve 12 can be clear, opaque or colored, in whole or in part, or in combination. The colorant can be a dye, pigment, or fluorescer, or a combination. Additionally, the wall of the casing 11 can have materials embedded in it, such as, without limitation, glass, glitter, and/or beads.

Further, the sleeve 12 may be a metal spiral, much like a coil spring, which has a bright finish with or without a relief pattern. The spiral may have colored beads set in the sleeve. Alternatively, the sleeve 12 may be made of a polymer resiliently shaped into a helix and having a laminate of metal to simulate gold or silver.

Figure 3:
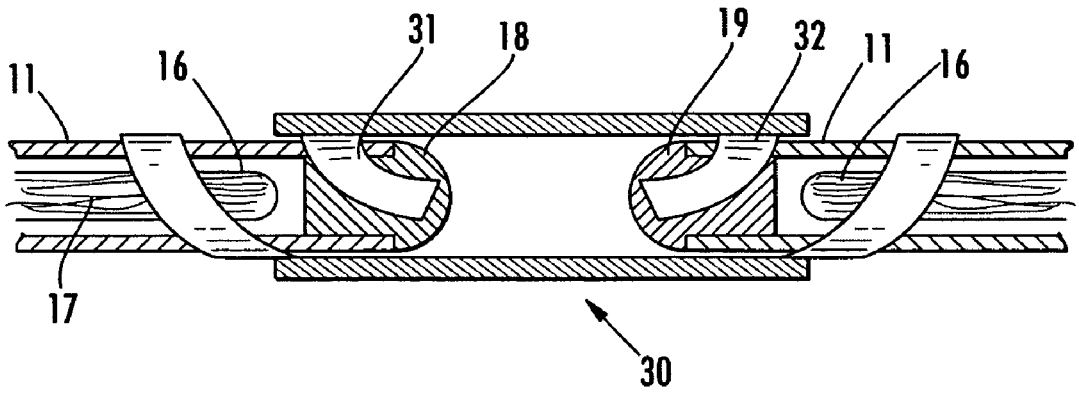
FIG. 3 is a longitudinal cross section of FIG. 2 showing the end connector.
Figure 4:
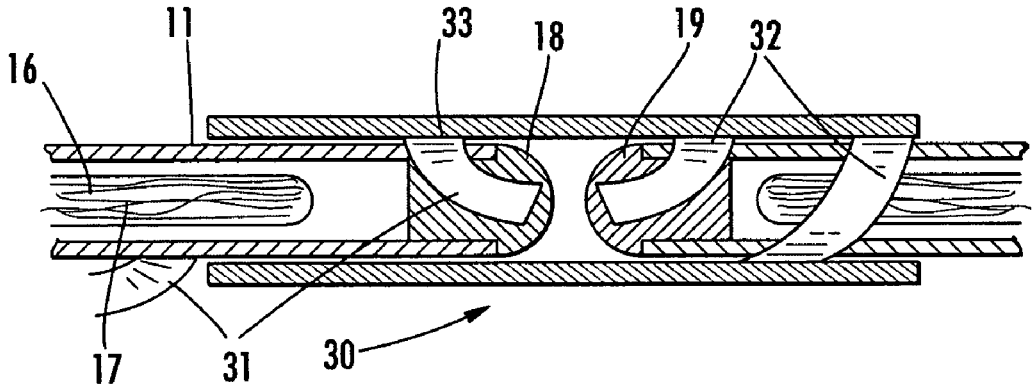
FIG. 4 is a longitudinal cross section of another embodiment of the connector of FIG. 3.

As shown in FIG. 3, the lighting device 10 has a relatively rigid sealed inner tube 16 containing one component 17 of the luminous agent. The inner tube is enclosed in a relatively flexible sealed casing 11. The casing 11 is larger than the inner tube to accommodate one of the components of a two part component system such as a quantity of oxidant between the inner tube 16 and the walls of the casing 11. In this embodiment, the end caps or plugs 18 and 19 act as enclosures. To produce illumination, the flexible casing 11 is bent resulting in the rupture of the inner tube 16. The resultant mixture of the luminous agent and the oxidant starts a chemical reaction producing visible and/or invisible light. This light has a perceived color based on the specific ingredients, for example green or red or other color. The luminous agent and/or the oxidant can be clear, opaque or colored or a combination. The colorant can be a dye, pigment, or fluorescer, or a combination. Additionally, either or both the chemiluminescent components can have materials in it, such as, without limitation, glass, glitter, and/or beads.

Also shown in FIGS. 3 and 4, the connector 30 is a short tubular structure made of a polymer in a size and shape to telescope over the ends of the outer casing 11 when the ends of the casing are brought together to form a necklace or bracelet. The telescoped connection between the connector and the ends of the casing will hold the casing in a 360 degree arc. The ends 31, 32 of the sleeve 12 are captured between the casing 11 and the connector 30 to lock the sleeve in place about the casing. The ends 31, 32 of the sleeve form an irregular surface in the telescoped connection and contribute to the strength of the connection. The connector 30 and the sleeve 12 may each be a separate element of the device. The connection may be opened and closed repeatedly from either end.

Or, as shown in FIG. 4, the connector 30 and one end 31 of the sleeve may be permanently attached to one end of the casing to prevent complete separation of the several components of the device. Sleeve end 31 and connector 30 have a molded junction 33 with each other and the casing. Any other conventional attachment may be used, such as adhesives, heat and pressure or others. The other end of the sleeve 32 may be permanently attached to the casing, if desired.

However, the end 32 of the sleeve and the connector 30 form a closure that can be opened and closed.

Figure 5:
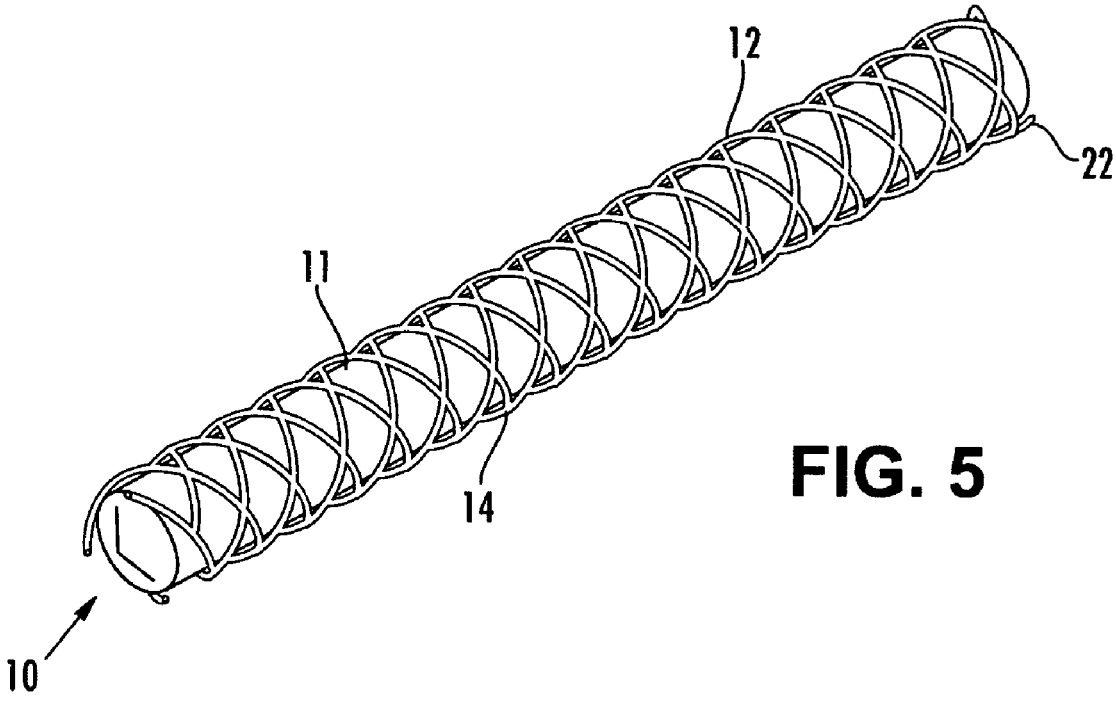
FIG. 5 is a perspective of another net sleeve.
Figure 6:
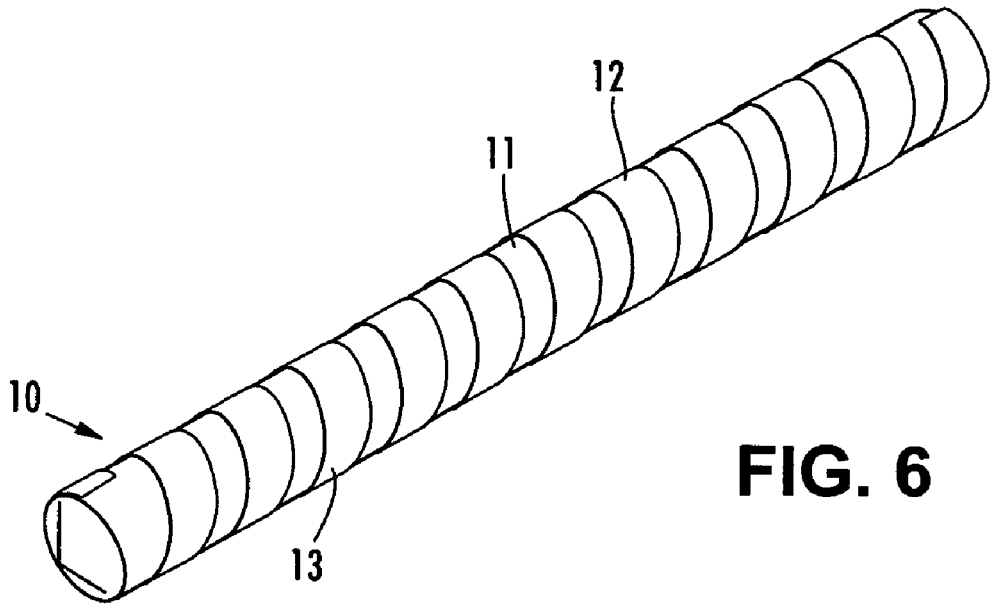
FIG. 6 is a perspective of another spiral sleeve.

In the event that the sleeve 12 is formed of a transparent, translucent, opaque polymer, or metallized polymer without additives, the lighting device 10 would appear to have a spiral or net or stripes of a different shade of the same color as the casing 11. As illustrated in FIGS. 5–6, it is also within the purview of the invention to provide the entire sleeve in a different color or as a light blocker to produce a barber pole, checked or striped effect with different colors from the casing 11 and the sleeve.

As shown in FIGS. 1 and 2, the sleeve 12 has additives 20 included in the polymer. These additives may be in the form of powders or particles of dye or other material that will emit a different color than the monochromatic light striking the sleeve from within. Also included are other additives 21 which are phosphorescent or fluorescent and will appear to glow when struck by the chemiluminescent light. Because of the luminescence of these additives, a brighter emission is perceived. These additives may be used together or separately for different visual effects.

The sleeves formed as a helix 13 and net 14 may be produced as separate tubular elements from the chemiluminescent lighting devices. The polymer from which the sleeves are fabricated have the necessary flexibility, elasticity, size, and shape to be telescoped onto the casing of a chemiluminescent lighting device and remain in place. In this way various colors may be added to a monochromatic lighting device.

Figure 7:
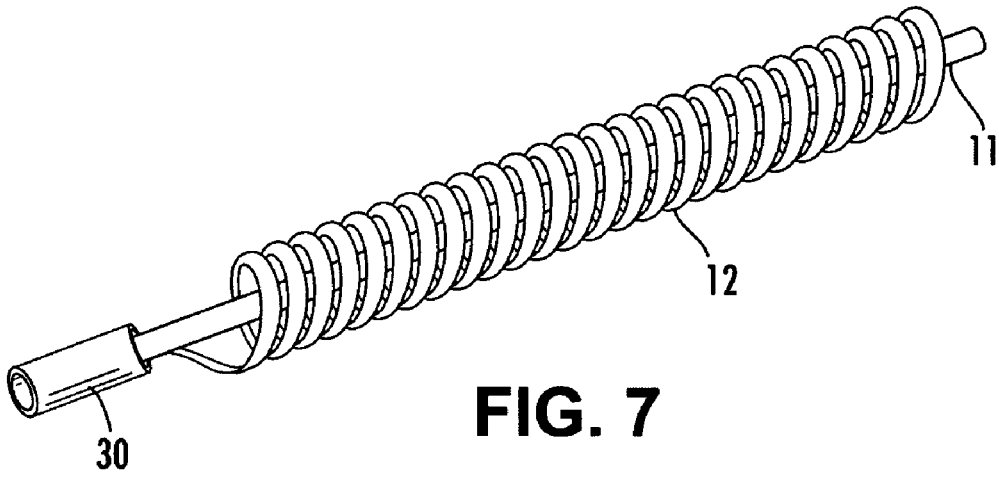
FIG. 7 is a perspective view of an enlarged spiral sleeve.
Figure 8:
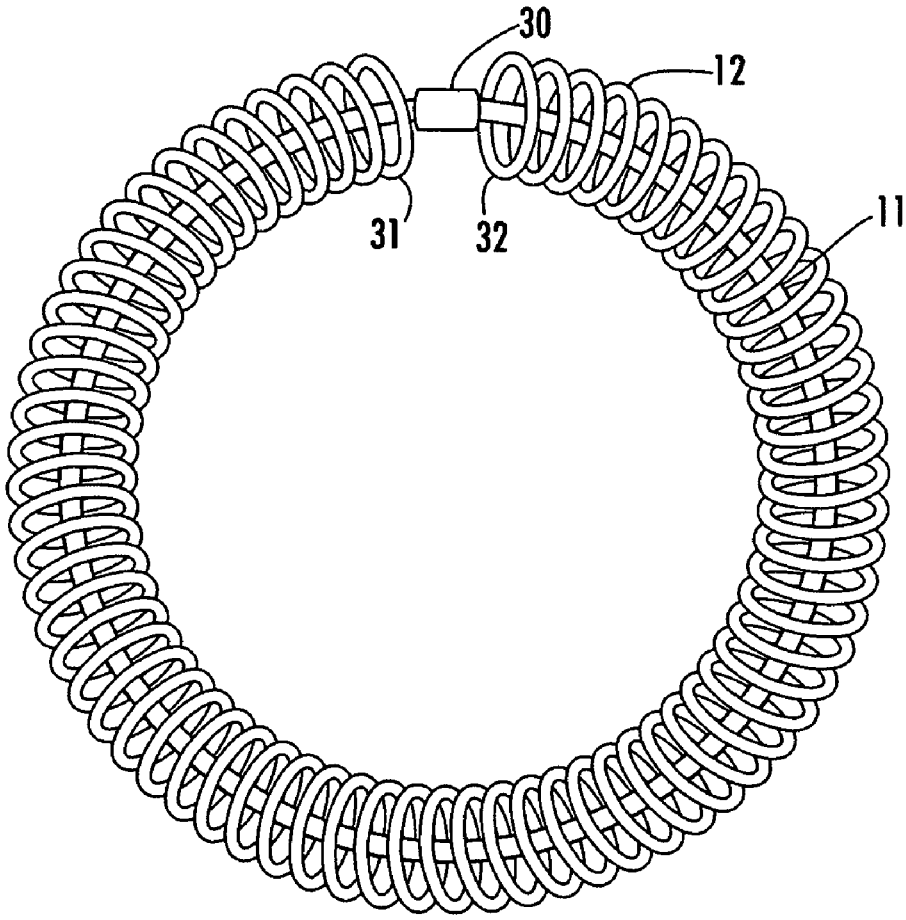
FIG. 8 is a perspective view of the spiral sleeve in FIG. 7 with the ends coupled together to form a necklace or bracelet.

As shown in FIGS. 7 and 8, the lighting devices 10 of this invention have a casing 11 through which light passes from the chemical reaction within the casing. Surrounding the casing 11 is a sleeve 12 which also passes light and may be transparent, translucent or opaque in whole or in part, or in combination. Ends 31 and 32 of the sleeve 12 are positioned beneath the coupler 30. In this embodiment, the sleeve is formed of a spiral configuration that assimilates a coil spring. When the coupler 30 is secured to each end of the casing, as shown in FIG. 8, the device creates a necklace or bracelet. The sleeve 12 can be made from a different material than the polyethylene or polypropylene of the tubular casing 11. The sleeve is a polymer, such as vinyl, which is aesthetically pleasing when gripped or carried by the user and further provides an asetically pleasing necklace or bracelet. Ends 31, 32 of the sleeve 12 are captured between the casing 11 and the connector 30 to lock the sleeve in place about the casing. In this embodiment, a casing used for a necklace may be double looped to reduce the opening size and be worn as a bracelet. The connector 30 and the sleeve 12 may each be a separate element of the device. The connection may be opened and closed repeatedly from either end.

In the event that the sleeve 12 is formed of a transparent, translucent, opaque polymer, or metallized polymer without additives, the lighting device 10 would appear to have a spiral coil of a different shade of the same color as the casing 11. It is also within the purview of the invention to provide the entire sleeve in a different color or as a light blocker to produce a barber pole or striped effect with different colors from the casing 11 and the sleeve.

While the removable sleeves of this invention have been discussed in relation to chemiluminescent light, these sleeves may be used in conjunction with lighting devices having other light generating devices, such as batteries or wind generators.

It will be apparent to those skilled in the art that various changes may be made without departing from the scope of the invention and the invention is not to be considered limited to what is shown in the drawings and described in the specification.

What is claimed is:

1. A chemiluminescent lighting device kit comprising:

a transparent casing adapted to house chemiluminescent reactants capable of producing light in the visible spectrum;

a sleeve surrounding said casing and formed from a material having an improved tactile property, said sleeve allowing said light to pass therethrough, said sleeve is constructed and arranged for movement about said casing during normal use wherein said movement results in changes in color when light emanating from said casing passes through said sleeve.

2. The kit according to claim 1 wherein said sleeve is separate and forms a spiral about said casing.

3. The kit according to claim 1 wherein said casing is formed from a polymer, said sleeve is formed of a different polymer, said sleeve is securable to said vessel casing.

4. The kit according to claim 1 wherein said sleeve is colored, whereby said sleeve appears as a first color and said casing appears as another color when visible light from said chemiluminescent light is passed therethrough.

5. The kit according to claim 4 wherein said sleeve is formed as a net structure with intersecting portions of said net defining interstices, said interstices exposing said casing.

6. A chemiluminescent lighting device capable of producing illumination throughout the spectrum of light comprising a chemiluminescent source of light, a casing surrounding said light, at least a portion of said light passing through said casing, said portion having one wavelength, a separate sleeve surrounding said casing, said sleeve allowing said light to pass therethrough, said sleeve including a material capable of producing another wavelength as said source of chemiluminescent light passes therethrough whereby at least two different wavelengths of light are produced, said sleeve is constructed and arranged for movement about said casing during normal use wherein said movement results in changes in color when light emanating from said casing passes through said sleeve.

7. The chemiluminescent lighting device of claim 6 wherein said sleeve is formed of a flexible polymer, said sleeve including fluorescing material disposed in said sleeve whereby a plurality of colors and intensities of light are produced.

8. The chemiluminescent lighting device of claim 6 wherein said sleeve is formed of a flexible polymer, said sleeve including discreet pieces of fluorescing material disposed in said sleeve whereby a plurality of colors and intensities of visible light are produced.

* * * * *